US006435480B1

(12) United States Patent
Allen

(10) Patent No.: US 6,435,480 B1
(45) Date of Patent: Aug. 20, 2002

(54) WINCH AND WINCH DRUM

(75) Inventor: Peter George Allen, Hampshire (GB)

(73) Assignee: Lewmar Limited, Hampshire (GB)

( * ) Notice: Subject to any disclaimer, the term of this patent is extended or adjusted under 35 U.S.C. 154(b) by 0 days.

(21) Appl. No.: 09/763,316

(22) PCT Filed: Aug. 25, 1999

(86) PCT No.: PCT/GB99/02798

§ 371 (c)(1),
(2), (4) Date: Feb. 22, 2001

(87) PCT Pub. No.: WO00/12423

PCT Pub. Date: Mar. 9, 2000

(30) Foreign Application Priority Data

Aug. 28, 1998 (GB) ..... 9818921

(51) Int. Cl.[7] ..... B66D 1/30

(52) U.S. Cl. ..... 254/371; 254/266; 254/278; 242/613.2

(58) Field of Search ..... 254/213, 266, 254/278, 371, 372, 374; 242/613, 613.1, 613.2

(56) References Cited

U.S. PATENT DOCUMENTS

| | | | | |
|---|---|---|---|---|
| 1,475,250 A | * | 11/1923 | Sundh | 254/266 |
| 4,274,606 A | | 6/1981 | Bernwall | |
| 4,688,765 A | | 8/1987 | Guangorena | |
| 5,829,736 A | * | 11/1998 | Harken | 254/278 |
| 5,947,451 A | * | 9/1999 | Cavanagh | 254/371 |

FOREIGN PATENT DOCUMENTS

| | | | | |
|---|---|---|---|---|
| DK | 84055 | * | 8/1957 | 254/371 |
| EP | 0 637 565 | | 2/1995 | |
| EP | 0 887 302 | | 12/1998 | |
| WO | 94 06710 | | 3/1994 | |

* cited by examiner

*Primary Examiner*—Emmanuel M. Marcelo
(74) *Attorney, Agent, or Firm*—Burns, Doane, Swecker & Mathis, L.L.P.

(57) ABSTRACT

Rope-holding characteristics of a winch drum (2) are determined by a staggered array of pyramidal protuberances (12, 14, 17, 19) on its surface. The staggering is such that there is no true circular path round the drum within the array, and a rope wound on it in the hoop direction is deflected sinusoidally.

10 Claims, 2 Drawing Sheets

WINCH AND WINCH DRUM

The present invention relates to winches and winch drums and in particular to winch drum surface finishes.

Winches are commonly used in marine applications to control the length or slackness of a rope acted on by the rotatable drum of the winch. An important feature of the winch drums of such winches is the finish applied to the rope-gripping surface of the drum. Different types of finish produce different grip characteristics. However, because a given finish will always cause rope wear, in practice the choice of a particular finish for a given application will often represent a compromise between grip and wear.

One conventional finish is provided by shot-peening. In this process, small hard objects (typically ceramic grit) are fired at the grip surface of the winch drum. The result is a random arrangement of relatively fine (in relation to the dimensions of the drum) peaks and troughs on the grip surface of the winch drum.

Peened finishes provide good gripping characteristics and controlled letting-off of rope, but have a tendency to promote premature rope wear. In addition, the quality of the peened finish can be variable. That is, peened finishes are susceptable to variations caused by e.g. changes to the velocity and direction of the peening objects. Subsequent processing can also affect the finish. For example, chrome plating onto a peened brass surface will tend to "soften" the finish of the brass surface. Thus there are many factors which can make it difficult to maintain the reproducibility of peened finishes.

It is also difficult to quantify the essential parameters of any particular finish (meaning those parameters which determine grip and wear) because of the essentially random nature of the arrangement of peaks and troughs. This can be a particular disadvantage if it is desired to investigate systematically the effects of different finishes on rope grip and rope wear, e.g. by varying systematically the parameters of the finish.

Another known finish consists of having an arrangement of vertical slots or ribs on the grip surface of the drum. The slots or ribs are generally parallel to the axis of rotation of the drum, i.e. perpendicular to the winding direction of the rope. However, the grip provided by this type of finish tends to be too strong so that when controlled release of the rope is attempted from the winch, large quantities of rope are let off at a time rather than an even, slow feed-off.

FR-A-1214874 shows an auxiliary windlass for a fishing boat where frusto-conical projections are arranged on the drum in planes normal to the axis of rotation of the drum, with gap planes between them. The projections are to mesh with a fishing net being drawn onto or leff off from the boat. They do not engage the rope.

With an aim of providing a rope-gripping surface finish whose parameters are both measurable and adjustable, while also providing good rope control and acceptable rope wear, the present invention provides a winch drum in which the finish of a rope-gripping surface is provided by a regular staggered array of protuberances which are of generally pyramidal shape. Note that the term "pyramidal" is not to be construed as being limited to square-based pyramidal shapes, i.e. tetrahedra and other polygonally-based pyramidal shapes are also included. Preferably, circumferentially nearest-neighbour protuberances are staggered in the axial direction of the drum; in other words, the only array of protuberances is a staggered one. If as is also preferred there are not circular paths normal to the axis of rotation of the drum (the hoop direction of the drum), the effect is that a rope wound in the hoop direction around the drum experiences spaced axial forces on opposing and alternate sides so that the rope tends to follow to some extent a sinusoidal or otherwise snaking path. Faces of the pyramidal shapes may be concavely curved so that respective, radially innermost, edges of adjacent, corner-sharing protuberances form continuous, smooth junctions which prevent a rope wedging fast in the junctions. The pyramidal shapes may be produced by machining on a CNC lathe, but other production techniques, such as casting or pressing, can also be used. For convenience the pyramidal shapes will hereafter be referred to simply as pyramids.

By varying the height, base shape and size (i.e. the characterizing parameters) of the pyramids, it is possible to exert a high degree of control over the surface finish and its effects. In addition these characterizing parameters are readily quantifiable so that it is possible to correlate measurable characteristics of the surface finish with the performance of the finish. This permits a methodical approach to the optimization of the rope-gripping surface finish to be undertaken.

Furthermore, compared with solely peened finishes, quality control of the regularly patterned finish is much improved, as a high degree of control can be exerted over the machining or other operation which produces the finish.

In a preferred form of the rope-gripping surface, the protuberances are diamond-based pyramids, the regular pattern being formed from a tessellation of the diamond bases of the pyramids. Desirably the pyramids are arranged so that the long direction of the base of the pyramids is aligned to the hoop direction of the winch drum. It is found that such an arrangement can provide a good compromise between rope control and rope wear.

The present invention will now be described in relation to a specific embodiment and with reference to the following figures in which.

Figure 1:
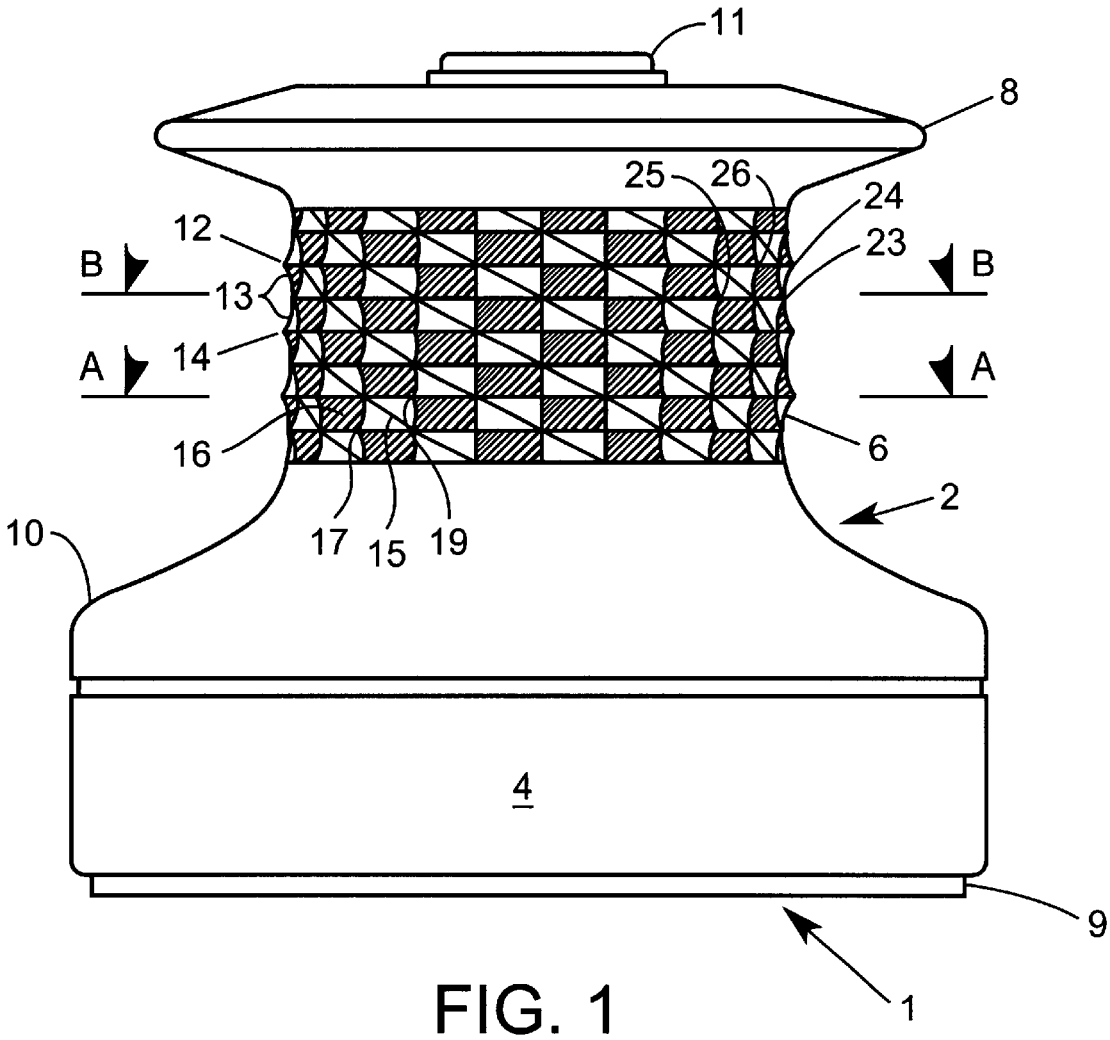
FIG. 1 shows a side view of a winch with a winch drum.

FIG. 1 shows a winch 1 on which is rotatably mounted a winch drum 2 having a skirt 4 and a rope-gripping surface 6 positioned between upper and lower lips 8,10. The rope-gripping surface is essentially cylindrical, of modified circular cross-section.

In use, the winch 1 is secured by its base 9 to a surface such as the deck of a yacht with the axis of rotation of the drum perpendicular to the surface, and a rope is wound around the rope-gripping surface, in single or multiple loops, the lips 8,10 preventing the rope from riding off the surface 6. Drive to rotate the drum can be applied from the head 11 of the winch, or from below the deck in conventional manner.

The surface 6 of the drum has a finish which comprises a regular pattern of diamond-based pyramidal protuberances. The apexes of the pyramids point radially outwardly and the long direction of the diamond bases of the pyramids are arranged parallel to the hoop direction of the drum 2 i.e. normal to the axis of rotation of the drum. The faces of the pyramids are gently concave and circumferentially nearest-neighbour pyramids are formed in zig-zag chains in the hoop direction of the drum. In other words, valley diamond edges of adjacent pyramids are coincident and form a network of zig-zag paths round the circumference of the drum. See, e.g. coincident valley edge 15 between peaks 17,19 which are thereby staggered relative to the hoop direction.

The pyramids produce an arrangement of peaks, troughs and ridges on the rope-gripping surface 6, which arrangement prevents the rope from uncontrollably sliding over the surface. Smooth and continuous junctions 15,16 are formed between respective joining edges of adjacent corner-sharing pyramids and axial ridges and faces of the pyramids are concavely curved (see, for example, the adjacent corner-sharing pyramids 12,14, viewed side on in FIG. 1). Note how the concave axial ridges 13 of axially-adjacent pyramids merge to form an essentially smooth arc.

By varying one or more dimension (e.g. pyramid height or base area) it is possible to optimize the grip between the surface 6 and a given type of rope, and to suit the drum material. In the present embodiment the longest dimension of the diamond base of each pyramid is approximately 20 mm, and the radial height of each pyramid is about 1.6 mm from the inscribed circle 20 (FIGS. 2 and 3).

Figure 2:
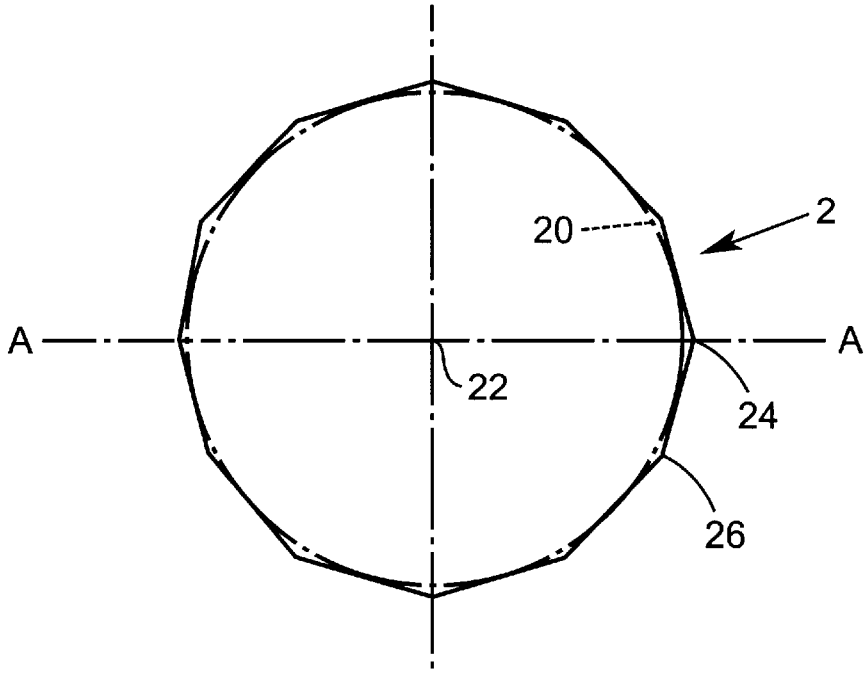
FIG. 2 shows a transverse section through the drum on the plane A—A.
Figure 3:
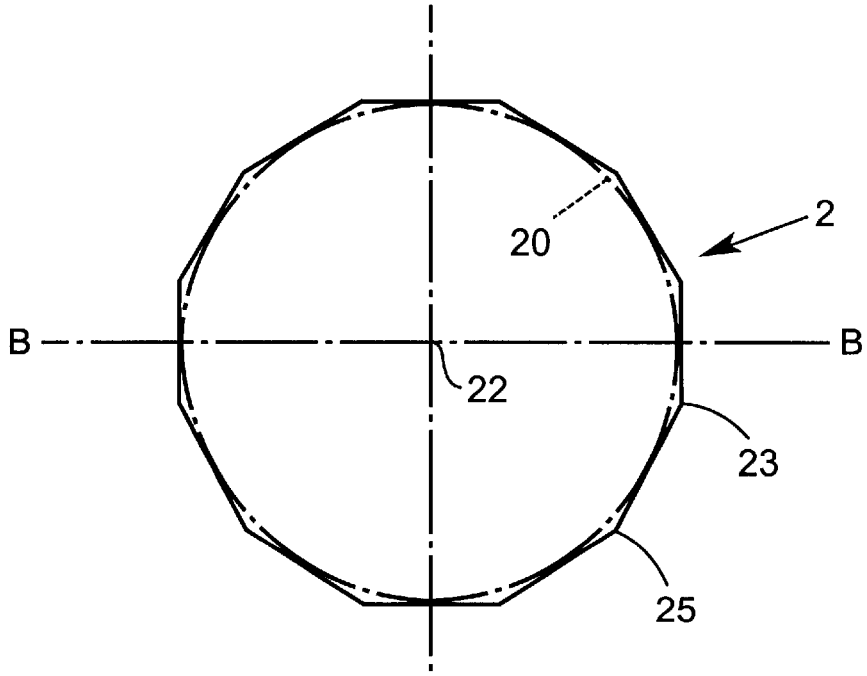
FIG. 3 shows a transverse section through the drum on the plane B—B.

FIGS. 2 and 3 show transverse sections of the drum at positions A—A and B—B respectively, the dot-dashed straight lines representing fixed spatial coordinate axes intersecting at the axis of rotation 22 of the drum. Clearly, as between section A—A and B—B, the relative positions of the peaks and troughs of the pattern are interchanged; compare peaks 24,26 in FIG. 2 and peak 23,25 in FIG. 3. In this embodiment there are three peaks in each quarter of the circumference. Straight lines join peaks 23,25 and peaks 24,26 and are the circumferential ridges of the respective pyramids.

However, the straight lines are intersected at their midpoints by the zig-zag valley paths 15. The cross-section of the drum surface includes therefore a series of parallel polygons with axially-adjacent neighbours offset relative to each other.

A rope wound round the drum is prevented from following an unperturbed hoop path around the drum because of the staggered pattern of protuberances. That is, the rope experiences spaced axial forces on alternate sides to an extent which compel it to follow a snaking path around the peaks of the pyramids. Also as the rope rides over the edges of the pyramids (for instance at edges 13), the edges bite into the rope to provide a controlled amount of grip.

Therefore, we believe that, as a result of the finish, the gripping force on the rope is part frictional and part mechanical in origin (ignoring here rope-to-rope interactions). In contrast, the gripping force on a rope from a solely peened finish is almost entirely frictional, as the peaks and troughs of a solely peened finish are at least an order of magnitude smaller than a typical rope diameter. For this reason, wear of ropes running over such peened surfaces is much greater. Of course, superficial surface finishes may if desired be applied to the surface of the present drum.

By optimizing the shape and dimension of the pyramids, a surface finish can be arrived at that represents a good compromise between rope wear, grip and controlled let-off. That is, different shapes and dimensions of pyramids will be suitable for different sizes of winch and thicknesses of rope, but by adjusting these characterizing parameters in a systematic manner, the optimum finish for a given combination of winch and rope can be found.

What is claimed is:

1. A winch drum for rotation about an axis, a rope-receiving surface of the drum having a regular axially-staggered pattern of protuberances of generally pyramidal shape.

2. A winch drum according to claim 1 where faces of the pyramidal shapes are concave.

3. A winch drum according to claim 2 wherein axial ridges of the pyramidal shapes are concave.

4. A winch drum according to claim 3 wherein the axial ridges of axially-adjacent protuberances form a single smooth arc.

5. A winch drum according to claim 1 wherein circumferentially nearest-neighbour protuberances have coincident edges and are staggered in the axial direction of the drum.

6. A winch drum according claim 1, wherein the protuberances have diamond-shaped bases.

7. A winch drum according to claim 6 wherein the major dimension of the diamonds is circumferentially of the drum.

8. A winch incorporating a winch drum according to claim 1.

9. A winch according to claim 8 which has a base for securing to a deck with the axis of rotation of the drum perpendicular to the deck.

10. A method of holding a rope on a drum of a winch which includes of causing the rope to lie with a sinusoidal path around the drum by passing between axially-staggered pyramidal protuberances on the surface of the drum.

* * * * *